US011326603B2

(12) United States Patent
Ye et al.

(10) Patent No.: US 11,326,603 B2
(45) Date of Patent: May 10, 2022

(54) TWO-STAGE COMPRESSOR WITH A GAS STORAGE CHAMBER BETWEEN STAGES AND AIR CONDITIONER HAVING SAME

(71) Applicant: GREEN REFRIGERATION EQUIPMENT ENGINEERING RESEARCH CENTER OF ZHUHAI GREE CO., LTD., Guangdong (CN)

(72) Inventors: Xiaofei Ye, Guangdong (CN); Xumin Zhao, Guangdong (CN); Ting Yan, Guangdong (CN)

(73) Assignee: GREEN REFRIGERATION EQUIPMENT ENGINEERING RESEARCH CENTER OF ZHUHAI GREE CO., LTD., Guangdong (CN)

( * ) Notice: Subject to any disclaimer, the term of this patent is extended or adjusted under 35 U.S.C. 154(b) by 53 days.

(21) Appl. No.: 16/633,577

(22) PCT Filed: Jun. 12, 2018

(86) PCT No.: PCT/CN2018/090816
§ 371 (c)(1),
(2) Date: Jan. 23, 2020

(87) PCT Pub. No.: WO2019/104993
PCT Pub. Date: Jun. 6, 2019

(65) Prior Publication Data

US 2021/0071665 A1 Mar. 11, 2021

(30) Foreign Application Priority Data

Nov. 30, 2017 (CN) ..... 201711243105.X

(51) Int. Cl.
*F04C 18/356* (2006.01)
*F04C 23/00* (2006.01)
*F04C 29/12* (2006.01)

(52) U.S. Cl.
CPC ..... *F04C 18/356* (2013.01); *F04C 18/3564* (2013.01); *F04C 23/00* (2013.01);
(Continued)

(58) Field of Classification Search
CPC .... F04C 18/356; F04C 18/3564; F04C 23/00; F04C 23/001; F04C 23/008; F04C 29/12
See application file for complete search history.

(56) References Cited

U.S. PATENT DOCUMENTS 7,290,994 B2 * 11/2007 Kitaichi ..... F04C 18/3564 418/11

FOREIGN PATENT DOCUMENTS

CN 1239757 A 12/1999
CN 1959116 A 5/2007
(Continued)

OTHER PUBLICATIONS

Machine translation of Chinese Patent Publication CN203081766U, Inventors: Lu et al, Title: Compressor, pump body assembly and high-pressure cylinder thereof, published: Jul. 24, 2013. (Year: 2013).*

(Continued)

*Primary Examiner* — Mary Davis
(74) *Attorney, Agent, or Firm* — Brandon V. Zuniga; James R. Gourley; Carstens & Cahoon, LLP

(57) ABSTRACT

Disclosed are a compressor and an air conditioner having same. The compressor includes: a first-stage cylinder, including a first-stage compression chamber; and a second-stage cylinder, including a second-stage compression chamber and a gas storage chamber. Refrigerant flowing out of the first-stage compression chamber flows through the storage chamber and enters into the second-stage compression chamber, and a flow area of the gas storage chamber is larger than an area of a gas outlet of the first-stage compression
(Continued)

chamber. The compressor effectively solves problems that power consumption of the compressor is increased and performance is reduced due to large resistance loss in the cylinder of the compressor.

20 Claims, 4 Drawing Sheets

(52) U.S. Cl.
CPC ..... *F04C 23/001* (2013.01); *F04C 23/008* (2013.01); *F04C 29/12* (2013.01)

(56) References Cited

FOREIGN PATENT DOCUMENTS

| | | | |
|---|---|---|---|
| CN | 203081766 | U | 7/2013 |
| CN | 104251207 | B | 4/2016 |
| CN | 105545737 | A | 5/2016 |
| CN | 108087272 | A | 5/2018 |
| CN | 207568841 | U | 7/2018 |
| JP | 2012251511 | A | 12/2012 |
| JP | 5199863 | B2 | 5/2013 |
| WO | 2010143521 | A1 | 12/2010 |

OTHER PUBLICATIONS

Extended European Search Report for European Application No. 18882876.8 dated Oct. 23, 2020 (6 pages).
International Search Report for Application No. PCT/CN2018/090816 dated Sep. 14, 2018 (3 pages).

* cited by examiner

TWO-STAGE COMPRESSOR WITH A GAS STORAGE CHAMBER BETWEEN STAGES AND AIR CONDITIONER HAVING SAME

CROSS-REFERENCE TO RELATED APPLICATION

This application is a U.S. National Stage of International Application No. PCT/CN2018/090816, filed on Jun. 12, 2018 and published as WO 2019/104993 on Jun. 6, 2019, which claims priority to Chinese Patent Application No. 201711243105.X, filed with the Chinese Patent Office on Nov. 30, 2017, the contents of which are hereby incorporated by reference in their entireties.

TECHNICAL FIELD

The present disclosure relates to the field of air conditioning, and in particular, to a two-stage compressor with a gas storage chamber between stages and an air conditioner having the same.

BACKGROUND

Most of the existing double-stage rotor compressors with enhanced vapor injection adopt the structure of a built-in medium-pressure chamber. The medium-pressure refrigerant flows through the enthalpy increasing component and is directly injected into the medium-pressure chamber. After being compressed in the first-stage cylinder, the low-pressure refrigerant is also discharged into the medium-pressure chamber. After being mixed in the medium-pressure chamber, the refrigerants from two portions flow through the medium-pressure and enter the suction inlet of the second-stage cylinder flow channel, and then is sucked into the second-stage cylinder and compressed in the second-stage cylinder, and finally is discharged. The high-speed medium-pressure refrigerant flows through the medium-pressure flow channel and directly enters the suction inlet of the second-stage cylinder, which causes reverse gas flow to some extent, and increases the flow resistance of the medium-pressure flow channel and the suction loss of the second-stage cylinder. Moreover, the suction flow channel of the second-stage cylinder is relatively longer and is located at a lower position below the height center of the cylinder, which increases the suction resistance of the second-stage cylinder, resulting in an increase in the power consumption and a reduction in the performance of the double-stage rotor compressor with enhanced vapor injection.

SUMMARY

The present disclosure aims to provide a two-stage compressor with a gas storage chamber between stages and an air conditioner having the compressor, so as to solve the problems that the power consumption of the compressor is increased and the performance is reduced due to large resistance loss of the refrigerant in the cylinder of the compressor in the prior art.

In order to achieve the above purpose, according to one aspect of the present disclosure, a compressor is provided. The compressor includes: a first-stage cylinder comprising a first-stage compression chamber; and a second-stage cylinder comprising a second-stage compression chamber and a gas storage chamber; wherein, refrigerant flowing out of the first-stage compression chamber flows through the gas storage chamber and enters the second-stage compression chamber; and a flow area of the gas storage chamber is larger than an area of a gas outlet of the first-stage compression chamber.

Further, a cross section of the gas storage chamber comprises a first curved section, a second curved section, and a first connecting line and a second connecting line respectively connected between the first curved section and the second curved section; and the first connecting line and the second connecting line extend in circumferential directions of the second-stage cylinder.

Further, the first curved section and the second curved section are in shapes of two semicircles arranged opposite to each other, and the first connecting line and the second connecting line are both curves.

Further, the first connecting line and the second connecting line are coaxially arranged; the first connecting line is tangent to both the first curved section and the second curved section; and the second connecting line is tangent to both the first curved section and the second curved section.

Further, the gas storage chamber is a through hole running through the second-stage cylinder in an axial direction, and a suction inlet of the second-stage compression chamber is disposed in a side wall of the gas storage chamber.

Further, a distance from a center of the suction inlet of the second-stage compression chamber to an upper end surface of the second-stage cylinder equals a distance from the center of the suction inlet of the second-stage compression chamber to a lower end surface of the second-stage cylinder.

Further, the suction inlet of the second-stage compression chamber is in a waist-circular shape.

Further, the compressor further includes a lower flange arranged below the first-stage cylinder; the lower flange is provided with a medium-pressure chamber; the first-stage cylinder is provided with a medium-pressure flow channel; refrigerant flowing out of the first-stage compression chamber flows through the medium-pressure chamber and the medium-pressure flow channel, then enters the gas storage chamber.

Further, the medium-pressure flow channel is arranged adjacent to the first curved section, and a suction inlet of the second-stage compression chamber is arranged adjacent to the second curved section.

Further, a baffle is further arranged between the first-stage cylinder and the second-stage cylinder; the baffle is provided with a circulating hole; and refrigerant flowing out of the medium-pressure flow channel flows through the circulating hole and enters the gas storage chamber.

Further, a cross-sectional shape of the circulating hole is same as a cross-sectional shape of the gas storage chamber.

Further, the compressor further comprises a baffle arranged between the first-stage cylinder and the second-stage cylinder; a medium-pressure chamber is arranged in the baffle; and after refrigerant flowing out of the first-stage compression chamber flows through the medium-pressure chamber, the refrigerant enters the gas storage chamber.

According to another aspect of the present disclosure, an air conditioner including the compressor above is provided.

In the technical solutions of the present disclosure, the refrigerant from the first-stage compression chamber of the first-stage cylinder flows through the gas storage chamber and enters the second-stage compression chamber of the second-stage cylinder. Since the flow area of the gas storage chamber is larger than the area of the gas outlet of the first-stage compression chamber, after the refrigerant fluid enters the gas storage chamber, both the flow rate and the pressure of the refrigerant decrease, and under the buffering effect of the gas storage chamber, the refrigerant smoothly enters the second-stage compression chamber, thereby reducing reverse flow of the refrigerant, reducing the flow resistance loss of the refrigerant during flowing, improving the suction efficiency of the second-stage cylinder, and ensuring the performance of the compressor.

BRIEF DESCRIPTION OF DRAWINGS

The accompanying drawings attached to the description form a part of the disclosure and are intended to provide a further understanding of the present disclosure. The illustrative embodiments of the present disclosure and the description thereof are used for explanations of the present disclosure, but are not intended to inappropriately limit the present disclosure. In the accompanying drawings.

Figure 1:
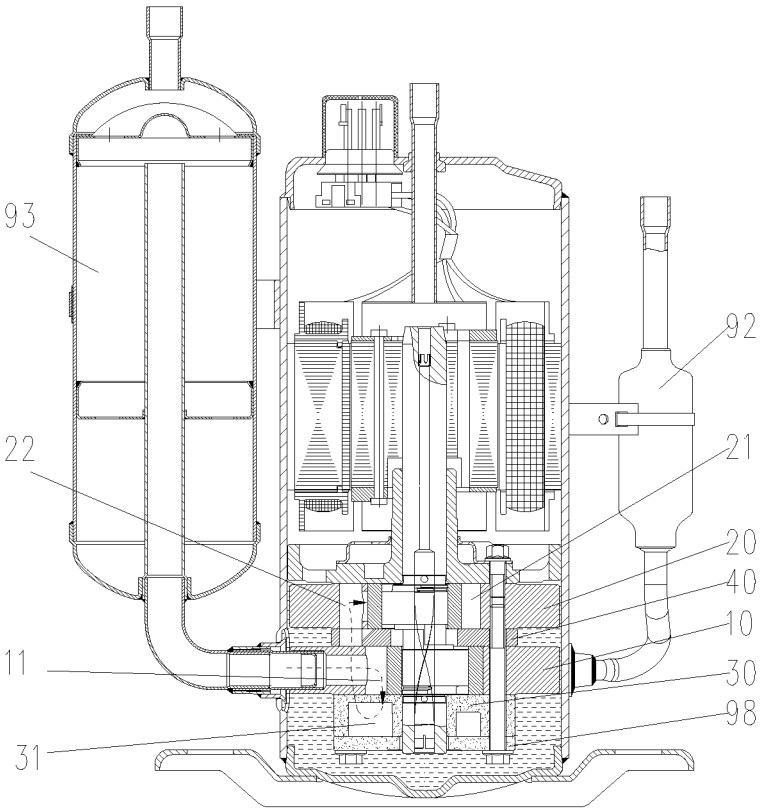
FIG. 1 is a schematic diagram illustrating a cross-sectional structure of a compressor according to an embodiment of the present disclosure.

The above drawings include the following reference signs:

10. first-stage cylinder; 11. first-stage compression chamber; 13. medium-pressure flow channel; 20. second-stage cylinder; 21. second-stage compression chamber; 22. gas storage chamber; 22*a*. first curved section; 22*b*. second curved section; 22*c*. first connecting line; 22*d*. second connecting line; 23. suction inlet; 30. lower flange; 31. medium-pressure chamber; 40. baffle; 41. circulating hole; 92. enthalpy increasing component; 93. liquid separator component; 98. lower cover plate.

DETAILED DESCRIPTION OF DISCLOSED EMBODIMENTS

The technical solutions in the embodiments of the present disclosure will be clearly and completely described hereafter with reference to the accompanying drawings of the embodiments of the present disclosure. Apparently, the embodiments in the description are merely some embodiments, but not all embodiments of the present disclosure. The following description of at least one exemplary embodiment is merely illustrative, but not intended to limit the present disclosure and the disclosure or the use thereof. Based on the embodiments of the present disclosure, other embodiments obtained by a person of ordinary skill in the art without creative efforts all fall within the protection scope of the present disclosure.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

Unless otherwise specified, the relative arrangements of the components and steps, numeric expressions and values described in these embodiments are not intended to limit the scope of the disclosure. Moreover, it should be understood that, for convenience of description, the dimensions of the parts shown in the accompanying drawings are not drawn to scale according to the actual proportion. The technologies, methods and equipment known to those of ordinary skill in the art may not be discussed in detail, but, where appropriate, the technologies, the methods and the equipment shall be considered as part of the granted specification. In all the examples shown and discussed herein, any specific value should be interpreted as merely an example, but not as a limitation. Other examples of illustrative embodiments may therefore have different values. It should be noted that similar reference numerals and letters in the following figures denote similar terms, therefore once a particular term is defined in one of the figures, no further discussion is required in the subsequent figures.

Figure 2:
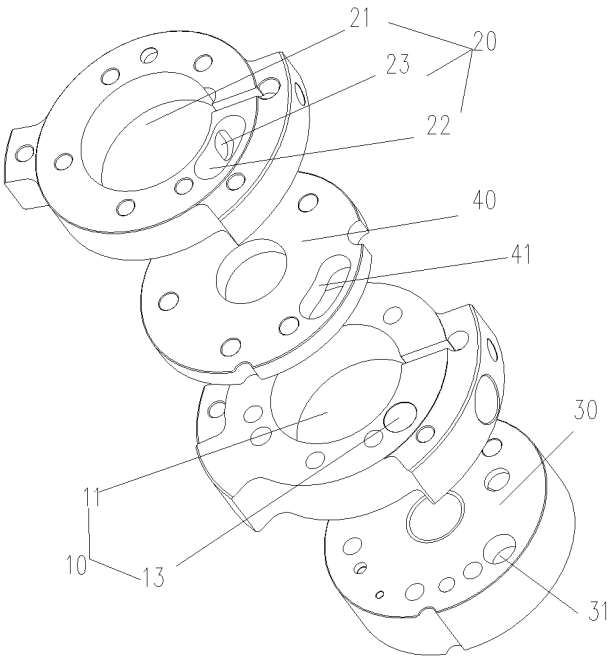
FIG. 2 is an exploded diagram illustrating partial structure of the compressor in FIG. 1.

As shown in FIGS. 1 and 2, the compressor of the present embodiment includes a first-stage cylinder 10 and a second-stage cylinder 20. The first-stage cylinder 10 includes a first-stage compression chamber 11, and the second-stage cylinder 20 includes a second-stage compression chamber 21 and a gas storage chamber 22. The refrigerant flowing out of the first-stage compression chamber 11 flows through the gas storage chamber 22 and enters the second-stage compression chamber 21. The flow area of the gas storage chamber 22 is larger than the area of the gas outlet of the first-stage compression chamber 11.

In the technical solution of the present embodiment, the refrigerant from the first-stage compression chamber 11 of the first-stage cylinder 10 flows through the gas storage chamber 22 and enters the second-stage compression chamber 21 of the second-stage cylinder 20. Since the flow area of the gas storage chamber 22 is larger than the area of the gas outlet 301 of the first-stage compression chamber 11, after the refrigerant fluid enters the gas storage chamber 22, both the flow rate and the pressure of the refrigerant decrease, and under the buffering effect of the gas storage chamber 22, the refrigerant smoothly enters the second-stage compression chamber 21, thereby reducing reverse flow of the refrigerant, reducing the flow resistance loss of the refrigerant during flowing, improving the suction efficiency of the second-stage cylinder 20, and ensuring the performance of the compressor.

Figure 6:
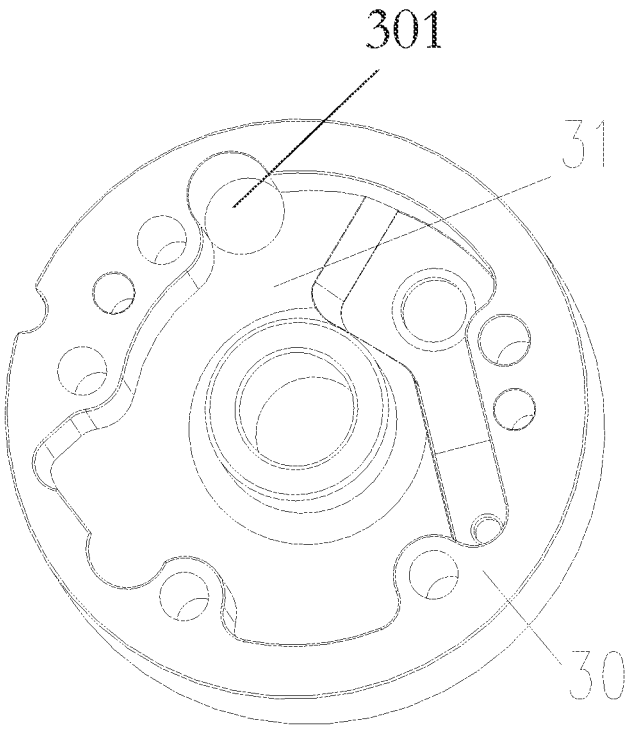
FIG. 6 is a structural schematic diagram of a lower flange of the compressor in FIG. 2.

Further, as shown in FIGS. 1, 2 and 6, the compressor of the present embodiment further includes a lower flange 30 arranged below the first-stage cylinder 10. The lower flange 30 is provided with a medium-pressure chamber 31, and the medium-pressure chamber 31 is sealed by a lower cover plate 98. The first-stage cylinder 10 is provided with a medium-pressure flow channel 13. The refrigerant flowing out of the first-stage compression chamber 11 flows through the medium-pressure chamber 31 and the medium-pressure flow channel 13, then enters the gas storage chamber 22. In the direction as indicated by a dashed arrow in the figure, the refrigerant is sucked into the compressor of the present embodiment through the liquid separator component 93; after being sucked by the first-stage cylinder 10, the refrigerant is also compressed in the first-stage cylinder 10 for a primary compression, and then is discharged into the medium-pressure chamber 31. The medium-pressure refrigerant sucked by the enthalpy increasing component 92 is also injected into the medium-pressure chamber 31. After the refrigerants from two portions are fully mixed in the medium-pressure chamber 31, the mixed refrigerant flows through the medium-pressure flow channel 13 and enters the gas storage chamber 22 and the suction inlet 23 of the second-stage cylinder 20, and then is sucked into the second-stage cylinder 20 and compressed in the second-stage compression chamber 21 for a secondary compression, and finally is discharged. In the existing compressor, since the high-speed medium-pressure refrigerant flows through the medium-pressure flow channel and directly enters the suction inlet of the second-stage cylinder, a certain reverse gas flow will be generated, thus increasing the flow resistance of the medium-pressure flow channel and the suction loss of the second-stage cylinder, and affecting the suction efficiency and the performance of the compressor. However, in the present embodiment, since the flow area of the gas storage chamber 22 is larger than the area of the gas outlet 301 of the first-stage compression chamber 11, the pressure of the fluid is reduced and the phenomenon of reverse gas flow is weakened, thereby reducing the flow resistance of the medium-pressure flow channel 13 and the suction loss of the second-stage cylinder 20, and effectively ensuring the working efficiency and the performance of the compressor.

Figure 3:
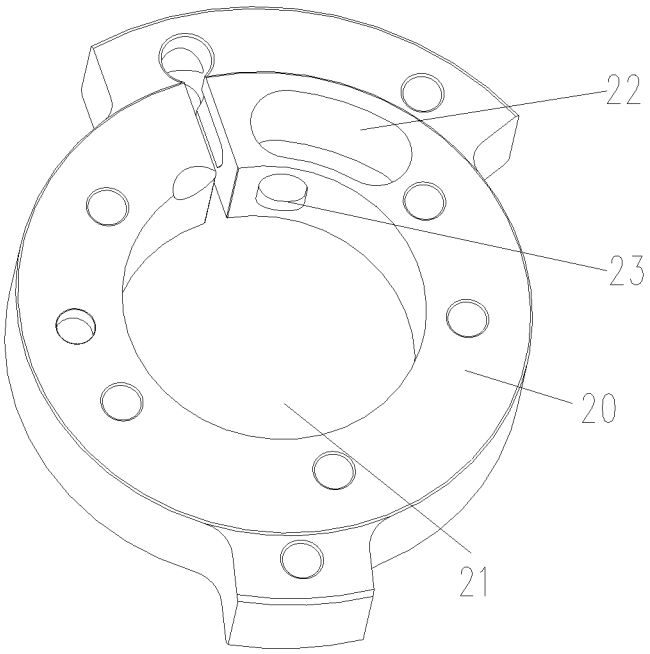
FIG. 3 is a structural schematic diagram of a second-stage cylinder of the compressor in FIG. 2.
Figure 4:
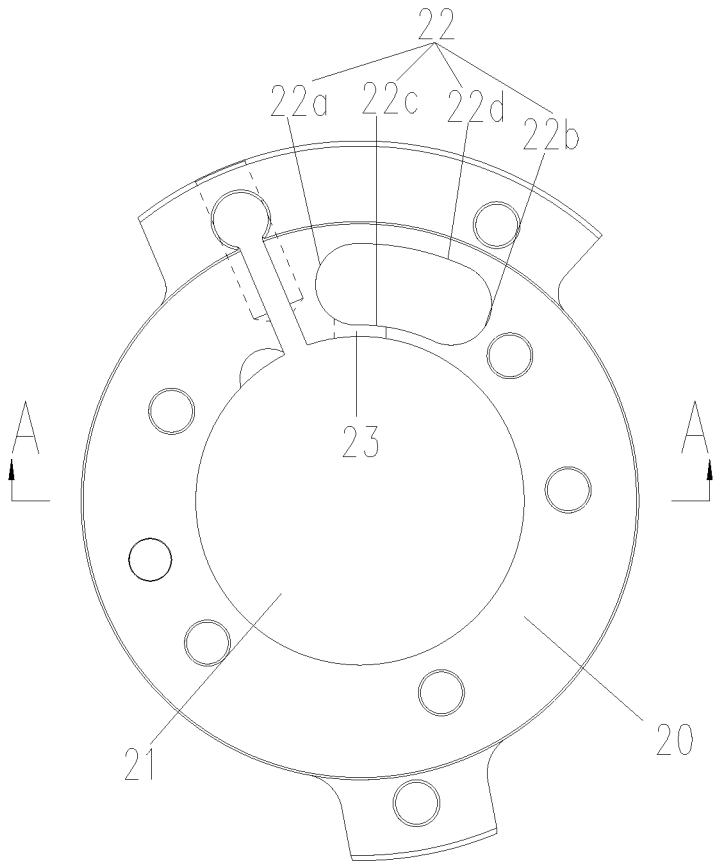
FIG. 4 is a schematic top view of the second-stage cylinder in FIG. 3.
Figure 5:
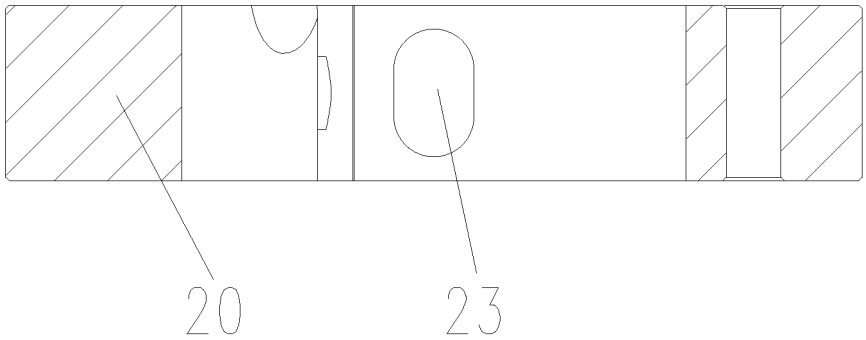
FIG. 5 is a schematic cross-sectional view of the second-stage cylinder in FIG. 4 in the direction A-A.

In an embodiment, as shown in FIGS. 3 to 5, the gas storage chamber 22 of the present embodiment is a through hole running through the second-stage cylinder 20 in the axial direction. The suction inlet 23 of the second-stage compression chamber 21 is disposed in the side wall of the gas storage chamber 22, so as to make full use of the space of the cylinder and enable the volume of the gas storage chamber 22 to be the largest, thereby fully buffering the high-speed refrigerant fluid entering the gas storage chamber 22.

Further, as shown in FIG. 5, in the present embodiment, the distance from the center of the suction inlet 23 of the second-stage compression chamber 21 to the upper end surface of the second-stage cylinder 20 equals the distance from the center of the suction inlet 23 of the second-stage compression chamber 21 to the lower end surface of the second-stage cylinder 20. The suction inlet 23 is located at the middle position of the side wall of the second-stage cylinder 20 in the height direction, which reduces the length of the suction channel, reduces the suction resistance of the second-stage cylinder 20, and reduces the suction loss of the second-stage cylinder 20.

Specifically, in the present embodiment, the suction inlet 23 of the second-stage compression chamber 21 is in a waist-circular shape. The waist-circular shape includes two oppositely arranged semicircles and two parallel lines respectively connecting respective ends of the two semicircles, and the extending directions of the two parallel lines are parallel to the axial direction of the second-stage cylinder 20.

Further, as shown in FIG. 2, in the present embodiment, a baffle 40 is further arranged between the first-stage cylinder 10 and the second-stage cylinder 20, and the baffle 40 is provided with a circulating hole 41. The refrigerant flowing out of the medium-pressure flow channel 13 flows through the circulating hole 41 and enters the gas storage chamber 22. Preferably, in the present embodiment, the cross-sectional shape of the circulating hole 41 is the same as the cross-sectional shape of the gas storage chamber 22, so that the circulating hole 41 can serve as an extension of the gas storage chamber 22, thereby further enhancing the buffering effect.

Specifically, in the present embodiment, as shown in FIG. 4, the cross section of the gas storage chamber 22 includes a first curved section, a second curved section, and a first connecting line and a second connecting line respectively connected between the first curved section and the second curved section; the first connecting line and the second connecting line extend in the circumferential direction of the second-stage cylinder 20, thereby further allowing the refrigerant to enter the second-stage compression chamber 21 smoothly and stably.

More specifically, in the present embodiment, as shown in FIG. 4, the medium-pressure flow channel 13 is circular, and accordingly, in the present disclosure, the first curved section 22*a* and the second curved section 22*b* are in shapes of two semicircles arranged opposite to each other, so as to correspond to the medium-pressure flow channel 13, thereby reducing sudden changes in the state of the refrigerant fluid when it flows between various structures of the compressor. Further, in the present embodiment, the first connecting line 22*c* and the second connecting line 22*d* are both curves, so that the refrigerant fluid flows stably to the suction inlet 23 of the second-stage compression chamber 21.

Preferably, in the present embodiment, the first connecting line 22*c* and the second connecting line 22*d* are coaxially arranged, that is, the center of the circle where the first connecting line 22*c* is located coincides with the center of the circle where the second connecting line 22*d* is located. Furthermore, the first connecting line 22*c* is tangent to both the first curved section 22*a* and the second curved section 22*b*, and the second connecting line 22*d* is tangent to both the first curved section 22*a* and the second curved section 22*b*. The above structure makes the flow areas at any positions in the gas storage chamber 22 similar, thereby reducing the state changes of the refrigerant fluid during flowing.

Moreover, as shown in FIG. 2, in the present embodiment, the medium-pressure flow channel 13 is arranged adjacent to the second curved section 22*b*, and the suction inlet 23 of the second-stage compression chamber 21 is arranged adjacent to the first curved section 22*a*, so that the refrigerant fluid is fully buffered in the gas storage chamber 22, thereby reducing the flow resistance loss and effectively preventing the refrigerant fluid from forming vortexes at both ends of the gas storage chamber 22.

In other embodiments not shown in the figure, the cross-sectional shape of the circulating hole may be the same as the shape of the gas outlet of the first-stage cylinder, or the cross-sectional shape of the circulating hole is transitional between the shape of the gas outlet of the first-stage cylinder and the shape of the gas storage chamber.

In other embodiments not shown in the figure, the medium-pressure chamber of the compressor can also be arranged in the baffle, and after the refrigerant flowing out of the first-stage compression chamber flows through the medium-pressure chamber, it enters the gas storage chamber.

The present disclosure also provides an air conditioner. According to the present embodiment, the air conditioner (not shown in the figure) includes a compressor, which is the compressor described above. The air conditioner of the present embodiment has the advantages that the compressor operates smoothly and reliably and has a long service life.

From the above description, it can be seen that the above embodiments of the present disclosure can achieve the following technical effects:

The refrigerant from the first-stage compression chamber of the first-stage cylinder flows through the gas storage chamber and enters the second-stage compression chamber of the second-stage cylinder. Since the flow area of the gas storage chamber is larger than the area of the gas outlet 301 of the first-stage compression chamber, after the refrigerant fluid enters the gas storage chamber, both the flow rate and the pressure of the refrigerant decrease, and under the buffering effect of the gas storage chamber, the refrigerant smoothly enters the second-stage compression chamber, thereby reducing reverse flow of the refrigerant, reducing the flow resistance loss of the refrigerant during flowing, improving the suction efficiency of the second-stage cylinder, and ensuring the performance of the compressor.

In the description of the disclosure, it should be understood that the directional or positional relationships, indicated by the terms "front", "back", "upper", "lower", "left", "right", "horizontal", "vertical", "horizontal", "top", and "bottom", are usually based on the directional or positional relationships shown in the accompanying drawings, and used only for the purpose of facilitating the description of the disclosure and simplifying the description, and that, in the absence of the opposite description, these terms indicating directions do not indicate and imply that the related devices or elements must have a specific direction or be constructed and operated in a specific direction, and are not intended to limit the scope of the disclosure; and the terms "inside" and "outside" refer to the inside and the outside of the outline of each component.

For convenience of description, spatially relative terms such as "above", "over", "on a surface of", "upper", etc., may be used herein to describe the spatial position relationships between one device or feature and other devices or features as shown in the drawings. It should be appreciated that the spatially relative term is intended to include different directions during using or operating the device other than the directions described in the drawings. For example, if the device in the drawings is inverted, the device is described as the device "above other devices or structures" or "on other devices or structures" will be positioned "below other devices or structures" or "under other devices or structures". Thus, the exemplary term "above" can include both "above" and "under". The device can also be positioned in other different ways (rotating 80 degrees or at other orientations), and the corresponding description of the space used herein is interpreted accordingly.

In addition, it should be noted that the terms such as "first" and "second" used to define components are merely intended to facilitate the distinction between the corresponding components, if not otherwise stated, the terms have no special meaning, and therefore cannot be understood to limit the protection scope of this disclosure.

The above descriptions are merely the preferred embodiments of the present disclosure, and are not intended to limit the present disclosure. For those skilled in the art, various modifications and changes can be made for the present disclosure. Any modifications, equivalent substitutions, improvements, etc., made within the spirits and the principles of the present disclosure are within the protection scope of the present disclosure.

What is claimed is:

1. A two-stage compressor with a gas storage chamber between stages, comprising:

a first-stage cylinder comprising a first-stage compression chamber;

a second-stage cylinder comprising a second-stage compression chamber and a gas storage chamber; wherein, the two-stage compressor is configured so that refrigerant flowing out of the first-stage compression chamber flows through the gas storage chamber and enters the second-stage compression chamber; and a flow area of the gas storage chamber is larger than an area of a gas outlet of the first-stage compression chamber.

2. The two-stage compressor according to claim 1, wherein, a cross section of the gas storage chamber comprises a first curved section, a second curved section, and a first connecting line and a second connecting line respectively connected between the first curved section and the second curved section; and the first connecting line and the second connecting line extend in circumferential directions of the second-stage cylinder.

3. The two-stage compressor according to claim 2, wherein, the first curved section and the second curved section are in shapes of two semicircles arranged opposite to each other, and the first connecting line and the second connecting line are both curves.

4. The two-stage compressor according to claim 3, wherein, the first connecting line and the second connecting line are coaxially arranged; the first connecting line is tangent to both the first curved section and the second curved section; and the second connecting line is tangent to both the first curved section and the second curved section.

5. The two-stage compressor according to claim 4, wherein, the gas storage chamber is a through hole running through the second-stage cylinder in an axial direction, and a suction inlet of the second-stage compression chamber is disposed in a side wall of the gas storage chamber.

6. The two-stage compressor according to claim 3, wherein, the gas storage chamber is a through hole running through the second-stage cylinder in an axial direction, and a suction inlet of the second-stage compression chamber is disposed in a side wall of the gas storage chamber.

7. The two-stage compressor according to claim 2, wherein, the gas storage chamber is a through hole running through the second-stage cylinder in an axial direction, and a suction inlet of the second-stage compression chamber is disposed in a side wall of the gas storage chamber.

8. The two-stage compressor according to claim 7, wherein, a distance from a center of the suction inlet of the second-stage compression chamber to an upper end surface of the second-stage cylinder equals a distance from the center of the suction inlets of the second-stage compression chambers to a lower end surface of the second-stage cylinder.

9. The two-stage compressor according to claim 7, wherein, the suction inlet of the second-stage compression chamber is in a waist-circular shape.

10. The two-stage compressor according to claim 9, wherein, the waist-circular shape includes two oppositely arranged semicircles and two parallel lines respectively connecting respective ends of the two semicircles, and the extending directions of the two parallel lines are parallel to the axial direction of the second-stage cylinder.

11. The two-stage compressor according to claim 2, further comprising a lower flange arranged below the first-stage cylinder; the lower flange is provided with a medium-pressure chamber; the first-stage cylinder is provided with a medium-pressure flow channel; refrigerant flowing out of the first-stage compression chamber flows through the medium-pressure chamber and the medium-pressure flow channel, then enters the gas storage chamber.

12. The two-stage compressor according to claim 11, wherein, the medium-pressure flow channel is arranged adjacent to the first curved section, and a suction inlet of the second-stage compression chamber is arranged adjacent to the second curved section.

13. The two-stage compressor according to claim 11, wherein, a baffle is further arranged between the first-stage cylinder and the second-stage cylinder; the baffle is provided with a circulating hole; and the two-stage compressor is configured so that refrigerant flowing out of the medium-pressure flow channel flows through the circulating hole and enters the gas storage chamber.

14. The two-stage compressor according to claim 13, wherein, a cross-sectional shape of the circulating hole is same as a cross-sectional shape of the gas storage chamber.

15. The two-stage compressor according to claim 11, wherein, the medium-pressure flow channel is circular, and the first curved section and the second curved section are in shapes of two semicircles arranged opposite to each other.

16. The two-stage compressor according to claim 1, further comprising a baffle arranged between the first-stage cylinder and the second-stage cylinder;

a medium-pressure chamber is arranged in the baffle; and the two-stage compressor is configured so that after refrigerant flowing out of the first-stage compression chamber flows through the medium-pressure chamber, the refrigerant enters the gas storage chamber.

17. An air conditioner, comprising the two-stage compressor of claim 1.

18. The air conditioner according to claim 17, wherein a cross section of the gas storage chamber comprises a first curved section, a second curved section, and a first connecting line and a second connecting line respectively connected between the first curved section and the second curved section; and the first connecting line and the second connecting line extend in circumferential directions of the second-stage cylinder.

19. The air conditioner according to claim 18, wherein the first curved section and the second curved section are in shapes of two semicircles arranged opposite to each other, and the first connecting line and the second connecting line are both curves.

20. The air conditioner according to claim 19, wherein the first connecting line and the second connecting line are coaxially arranged; the first connecting line is tangent to both the first curved section and the second curved section; and the second connecting line is tangent to both the first curved section and the second curved section.

* * * * *